United States Patent [19]

Straub

[11] 4,171,014

[45] * Oct. 16, 1979

[54] ARRANGEMENT FOR MOUNTING TUBES IN A TANK WALL

[75] Inventor: Hermann Straub, Winterthur, Switzerland

[73] Assignee: Sulzer Brothers Limited, Winterthur, Switzerland

[ * ] Notice: The portion of the term of this patent subsequent to Mar. 23, 1993, has been disclaimed.

[21] Appl. No.: 592,045

[22] Filed: Jun. 30, 1975

Related U.S. Application Data

[62] Division of Ser. No. 415,107, Nov. 12, 1973, Pat. No. 3,945,431.

[30] Foreign Application Priority Data

Nov. 28, 1972 [CH] Switzerland ..... 12278/72

[51] Int. Cl.[2] ..... F28F 9/04

[52] U.S. Cl. ..... 165/11; 165/178; 165/70

[58] Field of Search ..... 165/70, 81-83, 165/143, 158, 172, 3; 29/157.4; 113/118; 122/360, 365

[56] References Cited

U.S. PATENT DOCUMENTS

| | | | |
|---|---|---|---|
| 2,181,486 | 11/1939 | Jenkins | 165/70 |
| 2,187,555 | 1/1940 | Flindt | 165/70 |
| 2,209,974 | 8/1940 | Jacobus | 165/81 |
| 2,336,879 | 12/1943 | Mekler | 165/83 |
| 2,388,177 | 10/1945 | Patterson et al. | 122/365 |
| 2,660,411 | 11/1953 | Weber | 165/178 X |
| 2,736,400 | 2/1956 | Gay et al. | 165/81 |
| 3,052,452 | 9/1962 | Taga | 165/173 X |
| 3,945,431 | 3/1976 | Straub | 165/158 |

FOREIGN PATENT DOCUMENTS

| | | | |
|---|---|---|---|
| 730284 | 5/1955 | United Kingdom | 165/70 |

*Primary Examiner*—Charles J. Myhre
*Assistant Examiner*—Theophil W. Streule, Jr.
*Attorney, Agent, or Firm*—Kenyon & Kenyon

[57] ABSTRACT

The tank wall is provided with a cylindrical collar in which a perforated tube base is mounted; the base having a set of tubes passing through in gas-tight relation. A thin sheet metal membrane is secured peripherally on the tube base to form an enclosed gas-tight chamber through which the tubes pass. The membrane is also perforated to permit passage of the tubes in a gas-tight relationship. The enclosed chamber permits monitoring of the imperviousness of the connections between the tubes and the tube base.

8 Claims, 3 Drawing Figures

ARRANGEMENT FOR MOUNTING TUBES IN A TANK WALL

This is a division, of application Ser. No. 415,107, filed Nov. 12, 1973 now U.S. Pat. No. 3,945,431, granted Mar. 23, 1976.

This invention relates to an arrangement for mounting tubes in a tank wall.

Mounting arrangements have been known in which a set of tubes is passed through a tube base mounted in gas-tight relation in a tank wall. For example, it has been known to mount the steam-conducting tubes of a steam generator within a tube base connected to the housing of a combustion chamber of the steam generator. In such cases, use has been made of an expandable bellow to mount the tube base in the housing of the combustion chamber in order to obtain a gas-tight connection. However, the use of a bellow between the tube base and the housing makes the production of such an arrangement very expensive. Furthermore, this arrangement has not been suitable for use in nuclear reactor equipment. This is because the equipment requires the connections of the tubes in the tube base to be checked at any time for imperviousness and such cannot be readily accomplished.

Accordingly, it is an object of the invention to provide a tube mounting arrangement that can be used in association with tanks for nuclear reactor equipment and, at the same time, be of relatively low cost construction.

Briefly, the invention provides a tube mounting arrangement for a tank in which a tube base is connected in gas-tight relation to the tank wall and a thin sheet-metal membrane is peripherally connected with the tube base in gas-tight manner to define an enclosed gas-tight chamber. A set of tubes is passed through both the tube base and membrane in gas-tight relation such that the connections between the tubes and the tube base can be monitored for imperviousness.

The mounting arrangement allows a number of different types of monitoring techniques to be used to check the imperviousness of the connections between the tubes and the tubes-base on the one hand and the sheet-metal membrane on the other hand. One technique consists in subjecting the enclosed chamber between the tubes-base and sheet-metal membrane to pressure and in testing whether this pressure lasts. It is also possible to make the so-called helium test in which a helium atmosphere is produced on one side of the tube-base and the other side of the base is monitored by means of a special apparatus to determine whether helium passes through the tube-base. It is also possible to use the chamber between the sheet-metal membrane and the tube-base for the so-called washing test. In this test, the chamber is connected to a washing circuit having a circulating device and a detector apparatus by which any radioactivity passing from the other side of the tube-base into the chamber being washed through can be detected.

A further advantage of the mounting arrangement resides in that the sheet-metal membrane forms a supplementary seal in the event that the connections between the tubes and the tube-base become leaky. Because the sheet-metal membrane is connected arounds its entire periphery with the tube-base, there is only one connection place between these two members. This is particularly advantageous from the manufacturing point of view. The mounting arrangement moreover allows the dimensions of the tubes-base to be small because of the spacing between the tubes of the tube set. A further substantial advantage of the arrangement is that many sealing weldings can be made in a workshop prior to the installation of the arrangement in the tank. This is a simplier fabrication method and can be more reliably carried out in the workshop than at the final site of the tank.

In one embodiment, the sheet-metal membrane extends parallel to the tube-base. This allows small expansion movements to occur between the places of the connection of the sheet-metal membrane with the tubes, and the connection places of the sheet-metal membrane with the tube-base. Thus, no bellows are needed to take expansion movements.

These and other objects and advantages of the invention will become more apparent from the following detailed description and appended claims taken in conjunction with the accompanying drawings in which:

Figure 1:
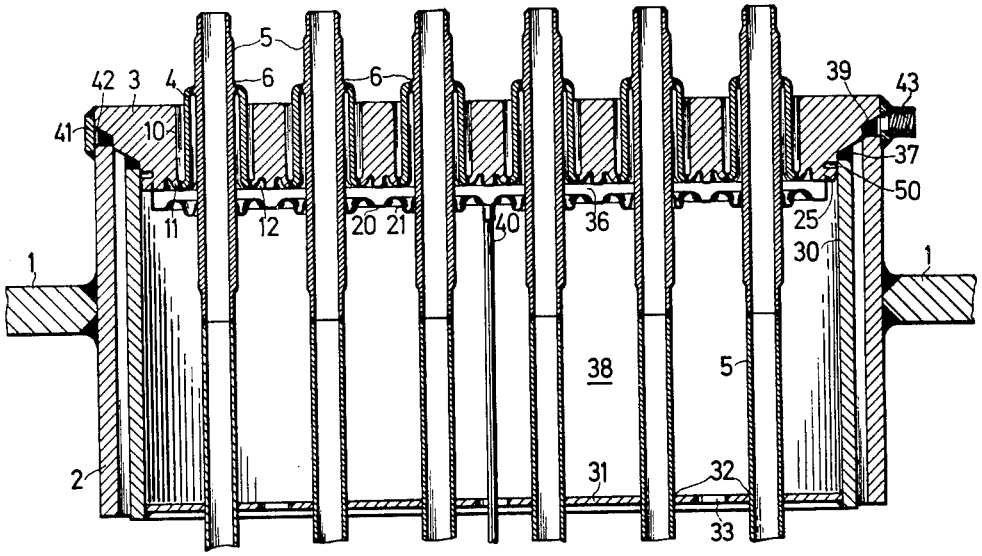
FIG. 1 illustrates a cross-sectional view through a mounting arrangement according to the invention.
Figure 3:
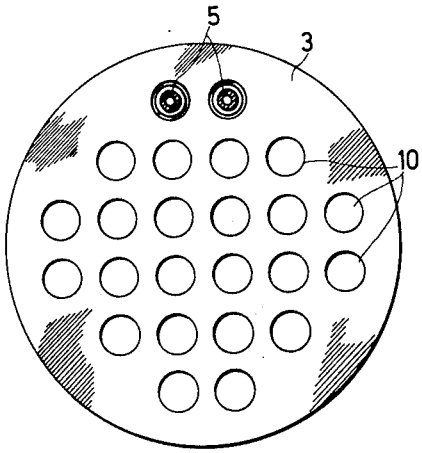
FIG. 3 schematically illustrates a simplified plan view of the arrangement of FIG. 1.
Figure 2:
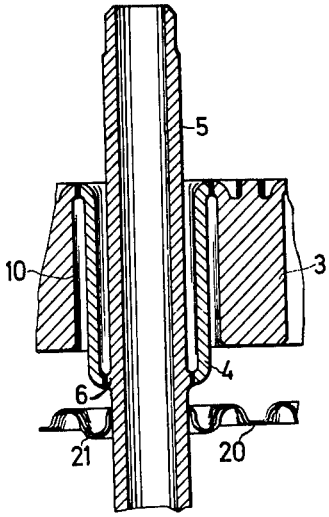
FIG. 2 illustrates to a larger scale than FIG. 1, a cross-sectional view through a part of a modified arrangement according to the invention.

Referring to FIG. 1, the wall 1 of a tank, for example, the safety tank of a nuclear reactor plant, has a suitable opening in which a cylindrical collar 2 is welded in gas-tight relation. The collar 2 projects at both sides from the wall 1. A tube base 3 is secured on the inside of the tank to the end face of the collar 2 in gas-tight relation by means of a welded seam 39. The tubes-base 3 has, for example, twenty four apertures 10 (FIG. 3) through each of which passes a tube 5 of a set of tubes. The wall-thickness of each tube 5 is greater in the pass-through region than in the adjoining regions on either side. Each tube 5 also has a circumferential rib 6 outside the tube base 3 to each of which is welded one end of a sleeve 4 of S-shape cross-section. As shown, each sleeve 4 extends through an aperture 10 in the tube base 3 between the tube 5 and base 3. The other end of the sleeve 4 is welded to a radial projection 11 of the tube base 3. Each radial projection 11 is formed by making an annular cut back 12 in the tube base 3 and by boring a part of the axial length of the aperture with a somewhat larger diameter than the inner diameter of the projection 11. In this way, shaping stresses are avoided in the region of the projections 11. The connection between the tubes 5 and the sleeves 4 on the one hand, and between the projections 11 and the sleeves 4 on the other hand, are advantageously made by electron-beam welding. As shown in FIG. 2, the sleeve 4 can be inverted from the position shown in FIG. 1.

A thin sheet metal membrane 20 is secured at the periphery to the tube base 3 at the outer side of the tank and is disposed in parallel to the tube base 3. As shown, the peripheral edge of the membrane is bent at right angles and is inserted via the thus-formed edge into a groove 25 in the tube base 3. The tube base 3 and the rim of the sheet-metal membrane 20 are connected together by hard-soldering. The tubes 5 pass through the sheet-metal membrane 20 which, in the region of each passage, has a circular undulation 21, which surrounds a tube 5 and is hard-soldered at the inner edge to the associated tube. The sheet-metal membrane 20 and the tube base 3 define an enclosed gas-tight chamber 36 which serves to monitor the gas-tightness of the connection between the tubes 5 and the tubes-base 3. For this purpose, a check-line 40 is connected in the center of the sheet-metal membrane 20 to detect pressure variations in the chamber 36 in order to signal leakage.

A cylinder 30 is mounted at the outside of the tank inside the collar 2 in surrounding relation to the set of tubes 5 and is connected at one end by a welded seam 37 with the tube base 3. A groove 50 is machined in the tube base 3 near the welded seam 37 in order to prevent excessive heating of the hard solder between the base 3 and the sheet-metal membrane 20 during welding. The other end of the cylinder 30 is provided with a plate 31 which is welded in the cylinder 30 and has openings 32 to position the tubes 5, as well as openings 33 to equalize the pressure between the atmosphere and the space 38 enclosed by the cylinder.

The weld seam between the collar 2 and the tube base 3 is bridged over by a ring 41, whose faces are welded in gas-tight relation to the tube base 3 and to the collar 2 respectively. This ring 41 forms an annular space 42 with the collar 2 and base 3 which space serves to check the imperviousness of the weld seam 39. For this purpose, the ring 41 can be connected through a nipple 43 with a check line (not shown).

Referring to FIG. 2, the places of welding of the sleeve 4 to the tube base 3 and the tube 5 can be interchanged so that the weld connection between sleeve 4 and tube 5 is near the hard-solder connection between the tube 5 and the sheet-metal membrane 20.

When a so-called washing test is to be carried out on the mounting arrangement, a further connection for a line is provided in addition to the connection of the line 40. The washing medium is then circulated through these two lines through the enclosed chamber 36. After flowing through the chamber 36 the flow is checked by a special apparatus to determine whether radioactive medium has penetrated from the tank into the washing medium.

What is claimed is:

1. The combination comprising a safety tank wall of a nuclear reactor plant, said wall having an opening therein;

a collar in said opening and secured in gas-tight relation to said wall;

a tube base connected in gas-tight relation to said collar;

a set of tubes extending through and connected with said tube base in gas-tight relation;

a thin sheet-metal membrane peripherally connected with said tube base in gas-tight manner and having said tubes extending therethrough and connected therewith in gas-tight relation, said membrane defining an enclosed gas-tight chamber with said tube base for monitoring the imperviousness of the connections between said tubes and said tube base; and a sleeve of S-shaped cross-section secured at each end to a respective one of said tubes and said tube base for securing each respective tube to said tube base in spaced relation to each other.

2. The combination as set forth in claim 1 wherein said membrane is disposed parallel to said tube base and wherein a check-line is connected to said membrane to detect pressure variations in said chamber.

3. The combination as set forth in claim 1 wherein said membrane is disposed on an outer side of said tank wall.

4. The combination as set forth in claim 1 wherein said membrane has a circular undulation surrounding each said tube.

5. The combination as set forth in claim 1 wherein each sleeve is connected to a respective tube at a point close to the connection of said tube to said membrane.

6. The combination as set forth in claim 1 which further comprises a cylinder mounted on said tube base within said collar and in surrounding relation to said tubes and a plate secured to said cylinder, said plate having apertures for guiding said tubes therethrough.

7. The combination as set forth in claim 1 which further comprises a weld seam between said collar and said tube base and a ring welded in gas-tight relation to said tube base and to said collar to define an annular space for checking the imperviousness of said weld seam.

8. The combination as set forth in claim 1 wherein said membrane is parallel to said tube base and permits expansion movements to occur between the places of the connection of said membrane with said tubes and the connection places of said membrane with said tube base.

* * * * *